US010247129B2

(12) United States Patent
DeGrace et al.

(10) Patent No.: US 10,247,129 B2
(45) Date of Patent: Apr. 2, 2019

(54) CYLINDER LINER FOR INTERNAL COMBUSTION ENGINE

(71) Applicant: GM GLOBAL TECHNOLOGY OPERATIONS LLC, Detroit, MI (US)

(72) Inventors: Garrold A DeGrace, Frankenmuth, MI (US); Maurice G Meyer, Fenton, MI (US); Paul Boone, Rochester Hills, MI (US); Gregory T Naismith, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 78 days.

(21) Appl. No.: 15/439,076

(22) Filed: Feb. 22, 2017

(65) Prior Publication Data

US 2018/0238263 A1 Aug. 23, 2018

(51) Int. Cl.
*F02F 1/00* (2006.01)
*F02F 1/14* (2006.01)

(52) U.S. Cl.
CPC ..... *F02F 1/14* (2013.01); *F02F 2001/008* (2013.01); *F02F 2200/06* (2013.01)

(58) Field of Classification Search
CPC ... F02F 1/004; F02F 2001/008; F02F 2200/06
USPC ..... 123/193.2, 669; 29/888.061
See application file for complete search history.

(56) References Cited

U.S. PATENT DOCUMENTS

| | | | | |
|---|---|---|---|---|
| 5,749,331 | A * | 5/1998 | Pettersson | C22C 33/0207 123/193.2 |
| 6,182,629 | B1 | 2/2001 | Gobbels et al. | |
| 6,468,673 | B2 | 10/2002 | Saito | |
| 6,640,765 | B2 | 11/2003 | Land et al. | |
| 6,732,632 | B1 | 5/2004 | Grahle et al. | |
| 6,776,127 | B2 | 8/2004 | Osman | |
| 7,171,935 | B2 | 2/2007 | Komai et al. | |
| 7,172,011 | B2 | 2/2007 | Bing et al. | |
| 7,226,667 | B2 | 6/2007 | Kodama et al. | |
| 7,665,440 | B2 | 2/2010 | Holtan et al. | |
| 7,806,098 | B2 | 10/2010 | Bing et al. | |
| 8,695,558 | B2 | 4/2014 | Reymond et al. | |
| 8,720,319 | B2 * | 5/2014 | Bischofberger | F02F 1/18 123/193.2 |
| 9,316,173 | B2 | 4/2016 | Highum | |
| 2005/0161014 | A1 | 7/2005 | Komai et al. | |
| 2006/0156917 | A1 * | 7/2006 | Oda | F02F 1/004 92/171.1 |
| 2015/0020757 | A1 * | 1/2015 | Highum | B22D 19/0081 123/41.01 |
| 2015/0377177 | A1 * | 12/2015 | Morgan | F02F 1/004 123/193.2 |
| 2016/0040620 | A1 * | 2/2016 | Highum | B22D 19/0081 123/41.72 |
| 2016/0069248 | A1 | 3/2016 | Beyer et al. | |

* cited by examiner

*Primary Examiner* — Marguerite McMahon

(57) ABSTRACT

A cylinder liner for an engine block that includes an inter-bore saw cut includes a first engine block bonding surface, and a second engine block bonding surface that has a lower level of bonding between the cylinder liner and an engine block than the first engine block bonding surface. The second engine block bonding surface extending from an axial end portion of the liner a distance greater than a depth of the saw cut in inter-bore section of the engine block.

15 Claims, 8 Drawing Sheets

CYLINDER LINER FOR INTERNAL COMBUSTION ENGINE

FIELD

The present disclosure relates to a cylinder liner for an internal combustion engine.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Cylinder liners for combustion engines made from, for example, cast iron, provide improved wear resistance in engine blocks that may be formed from lightweight materials, such as, for example, an aluminum alloy. These cylinder liners may be placed within an engine block mold and the engine block material may be cast around the cylinder liners. The cylinder liners are then embedded within and define the cylinder bores within the engine block. These liners are known as a "cast in place" type of liner.

It is important to maintain a strong bond between the liner and the block to prevent the liner from moving, to prevent or resist deformation during operation, and to improve thermal conductivity between the liner and the engine block. Cylinder liners which are known to provide an excellent mechanical and thermal bond include a rough exterior surface. These liner surfaces may be referred to as having an "as-cast," "spiny," or a rough cast surface. An example of such an "as-cast" surface may provide spines, mushrooms and crevices on the outside surface of the liner. Liners including exemplary "as-cast" surfaces may be provided by various manufacturers. One exemplary manufacturer, TPR Kabushiki Kaisha, holds a trademark registration for AsLock® for a cylinder liner under which they provide a liner having an as-cast external surface. Other manufacturers providing similar cylinder liners having a similar as-cast surface include Mahle, Federal Mogul and others.

Exemplary cylinder liners having an "as-cast" surface may include surface projections which extend between about 0.3 to 0.7 millimeters in depth on the external surface of the line and are generally produced using a centrifugal casting process. In contrast, other types of liners are typically manufactured by machining a billet cast extruded round stock bar. This results in a smooth machined external surface, rather than an "as-cast" surface and they are intended to be pressed into place in a previously cast engine block as opposed to being "cast-in-place".

A problem which has arisen when using such as-cast liners is that the liners have failed by, for example, cracking, especially near the deck of the engine block. This problem is especially evident when these as-cast liners are used with an open deck block in which a cooling fluid jacket surrounding each cylinder extends to the surface of the block and even more so in the presence of a slot or "saw cut" traversing the inter-bore area that connects the cooling fluid jacket on either side of a line of cylinder bores.

One attempt at addressing this problem has been to switch to a liner made from a material having a higher strength, such as a high strength steel liner, rather than a cast iron liner. However, high strength liners are more expensive than cast iron liners. Another approach has led to making the liners thicker and, thus, stronger. However, again, these liners are more expensive, and cost more to machine.

Another known response to these cracks or failures appearing in the cylinder liners has been to place a shim or wedge into the saw cut in an attempt to close, minimize the gap in the crack, or provide additional support to prevent further crack propagation. It would be greatly preferable to avoid the creation of these failures in the first place, thereby, obviating the complete failure of the engine and/or expensive and workload intensive repairs.

SUMMARY

In an exemplary aspect, a cylinder liner for an engine block that includes an inter-bore saw cut has a first engine block bonding surface, and a second engine block bonding surface that has a lower level of bonding between the cylinder liner and an engine block than the first engine block bonding surface. The second engine block bonding surface extending from an axial end portion of the liner a distance greater than a depth of the saw cut in inter-bore section of the engine block.

In another exemplary aspect, the first engine block bonding surface is an as-cast surface.

In another exemplary aspect, the as-cast surface is a spiny-lock surface.

In another exemplary aspect, the as-cast surface includes a plurality of projections radially extending between about 0.3 to 0.7 millimeters.

In another exemplary aspect, the second engine block bonding surface is a machined surface.

In another exemplary aspect, the first engine block bonding surface extends from the second engine block bonding surface across substantially the remaining axial extent of the liner.

In another exemplary aspect, the first engine block bonding surface is configured to provide a strong mechanical bond and a high thermal conductivity between the liner and the engine block and the second engine block bonding surface is configured to provide a reduced mechanical bond between the liner and the engine block such that a differing coefficient of thermal expansion between the liner material and the engine block material has a reduced stress transfer from the engine block to the liner during a cooling of the liner material and the engine block material in a casting process.

In another exemplary aspect, the second engine block bonding surface is configured to permit an axial displacement between the second engine block bonding surface and the engine block during a cooling of the cylinder liner and engine block material.

In another exemplary aspect, the second engine block bonding surface circumferentially extends across an area adjacent to the inter-bore section of the engine block, and the first engine block bonding surface extends from an axial end portion of the liner across the remaining circumferential extent.

In this manner, the underlying cause of the cylinder liner failures are directly addressed and prevented, thereby enabling the use of rough surface or "as-cast" cylinder liners that provide excellent mechanical bonding and thermal conductivity between the cylinder liner and engine block in combination with a saw cut in the engine block inner-bore area, without resorting to higher cost, high strength materials and while avoiding failures which have previously been experienced.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
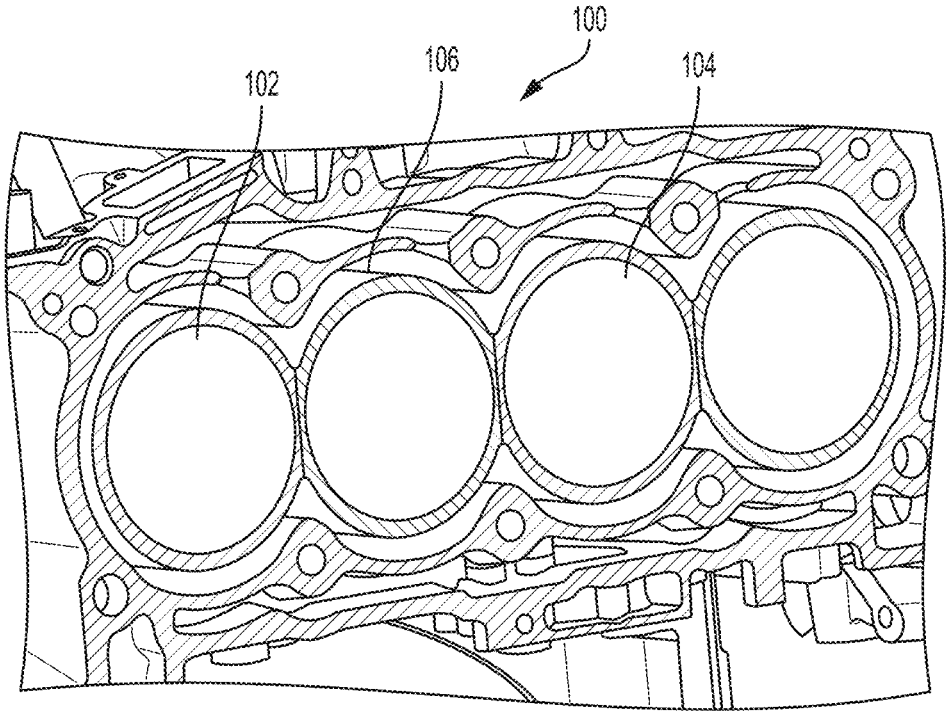
FIG. 1 is an isometric perspective view of an open deck engine block 100.

FIG. 1 illustrates an isometric perspective view of an open deck engine block 100. The engine block 100 includes a plurality of cylinder bores 102 that are defined by cylinder liners 104 which have been integrated into the engine block 100 during a casting process. In general, these cylinder liners 104 may be positioned into a mold and the molten engine block material, such as, for example, an aluminum alloy, may then be injected into the mold. The molten material then surrounds the cylinder liners as it fills the mold. The material cools to a solid and the liners are firmly bonded to the engine block material. In an exemplary process, the casting process may inject the molten engine block material under a high pressure to ensure intimate contact between the engine block material and the cylinder liner. As explained above, cylinder liners have been developed which include an "as-cast" exterior surface which provides an excellent structural and thermal bond between the liner and the engine block material.

The engine block 100 includes a cooling fluid jacket 106 which is exposed to ("open to") the deck surface 110 and is, thus, known as an "open deck" block. The cooling fluid jacket 106 substantially surrounds the cylinder bores and provides fluid communication channels through which cooling fluid may be circulated to remove and manage heat which may be generated during a combustion process during operation of an engine incorporating the engine block 100.

Figure 2:
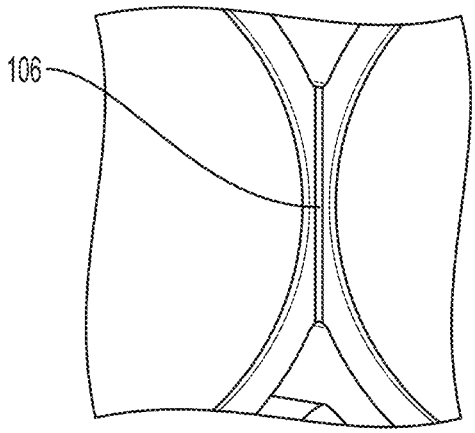
FIG. 2 is an isometric perspective view of an inter-bore portion of the engine block 100.

FIG. 2 is an isometric perspective providing a closer view of an inter-bore portion of the engine block 100. The inter-bore is known as the portion of the engine block which is between cylinder bores. One method of improving the management and removal of heat from the cylinder bores is to provide a fluid communication channel 108 in the inter-bore section to enable a flow of fluid between cooling fluid jacket 106 sections adjacent to the inter-bore. These fluid communication channels 108 may generally be known as a "saw cut" channel and this description will refer to these channels 108 as a "saw cut" channel hereafter. While this description refers to a "saw cut" the method or tools used to create the slot in the inter-bore area of the engine block is not limited to any particular method or tool.

As explained above, a problem is known in which cracks may develop in a cylinder liner near the deck surface and adjacent to the inter-bore area. While various attempts have been made to address this problem, none of them have understood the cause and addressed the underlying cause of these cracks. In contrast to previous attempts to address or solve this problem, the inventors studied the cause of the problem, discovered the source of the problem and, as a result, developed a solution which addresses the underlying cause of these cracks. The inventors were then able to solve the problem.

In particular, the inventors studied the manufacturing processes which included a structural analysis that accounted for the heat transfer and differences in coefficients of thermal expansion of the materials involved in the engine block casting process and subsequent process, such as, for example, machining of the bore, deck face, and the like. Through this unique analysis the inventors discovered the stresses and strains which resulted from these process and which are the cause of many cylinder liner failures.

Figure 3:
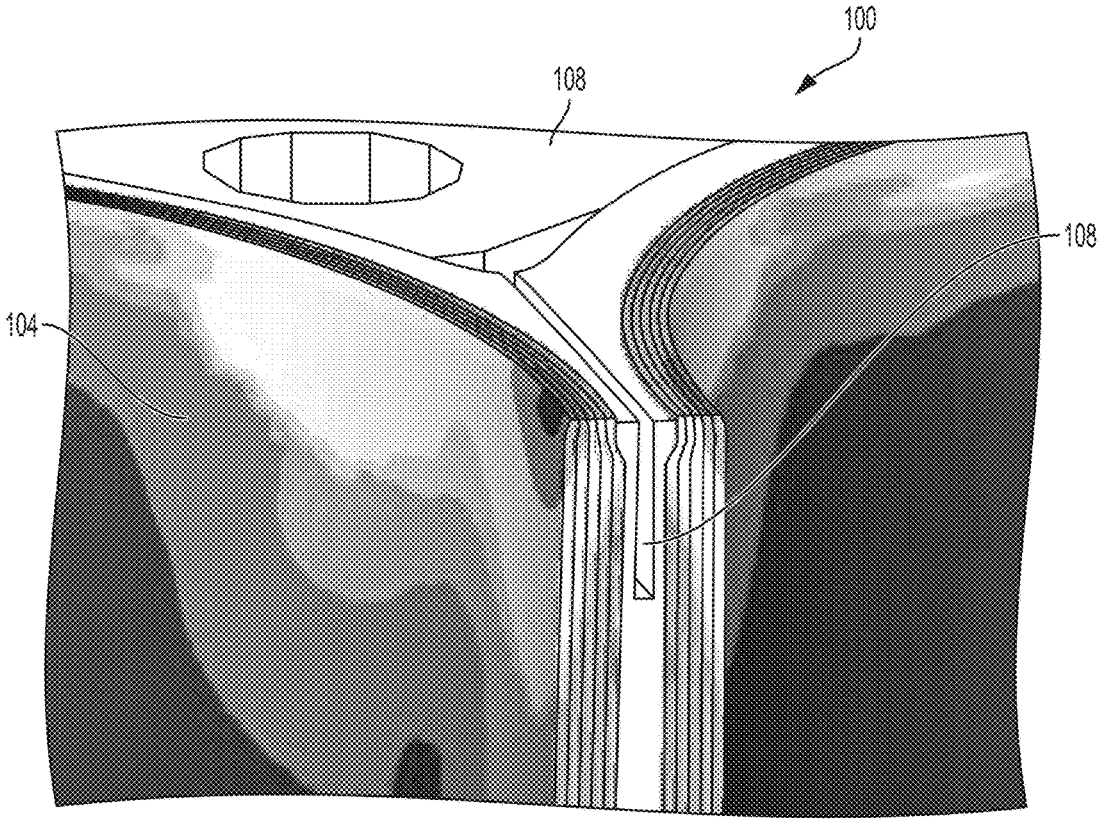
FIG. 3 is an isometric perspective cross-sectional view of an inter-bore section of the engine block 100.

FIG. 3 is an isometric perspective cross-sectional view of an inter-bore section of the engine block 100 which illustrates the residual stress in the cylinder liner 104 which results from the casting and machining processes using a computational model which accounts for the structural and thermal aspects of these processes, including the differences between coefficients of thermal expansion between the material of the cylinder liner 104 and the material of the engine block 100. In particular, FIG. 3 was generated by modelling the residual strain in a cylinder liner 104 made from a cast-iron material and an engine block 100 made from an aluminum alloy material. FIG. 3 clearly illustrates that the residual stress in the cylinder liner 104 is concentrated in an area near the deck face 108 and adjacent to the saw-cut 108.

The inventors, having studied this model, and further understanding that there is a substantial difference in the coefficients of thermal expansion between the cast-iron liner material and the aluminum alloy material and further appreciating that the "as-cast" surface of the liner provides a strong mechanical bond between the liner and the engine block material, the inventors discovered the cause of the problem. The aluminum alloy has a larger coefficient of thermal expansion than that of cast-iron. This means that the aluminum alloy will tend to shrink more than the cast-iron material as it cools. This has not generally caused problems in engine blocks which included cast in place cylinder liners which do not have an "as-cast" surface because the aluminum alloy is not as firmly bonded to the cylinder liner. In those situations, the aluminum alloy is free to "slide" down the surface of cylinder liner which reduces or substantially eliminates the residual stress that may otherwise be placed on the liner from the engine block material. In stark contrast, upon the introduction of cylinder liners having "as-cast" surfaces, which provide a much stronger structural bond between the cylinder liner and the engine block, the inventors realized that this resulted in the engine block material introducing stress in the cylinder liner. Unlike the non-as-cast surface liners, the potential for residual stress could not be alleviated by the engine block material sliding down the outside of the liner during the cooling process. Thus, cylinder liners having an "as-cast" surface experience residual stresses which are not present in liners that do not have an "as-cast" surface.

Further, the inventors realized that the presence of the saw-cut further focused this residual stress in the area of the liner adjacent to the inter-bore saw cut. The removal of material during the machining of the saw-cut enables the residual stress in the material to causes the liner to pivot or hinge radially outward from the cylinder bore. This residual stress tends to favor closing of the saw cut and thereby permits the engine block material and structurally bonded liner to be pulled downwardly and to pivot about the base of the saw-cut radially outward. FIG. 3 clearly illustrates the residual stress in the cylinder liner 104 which results from the causes discovered and understood by the present inventors.

Figure 4:
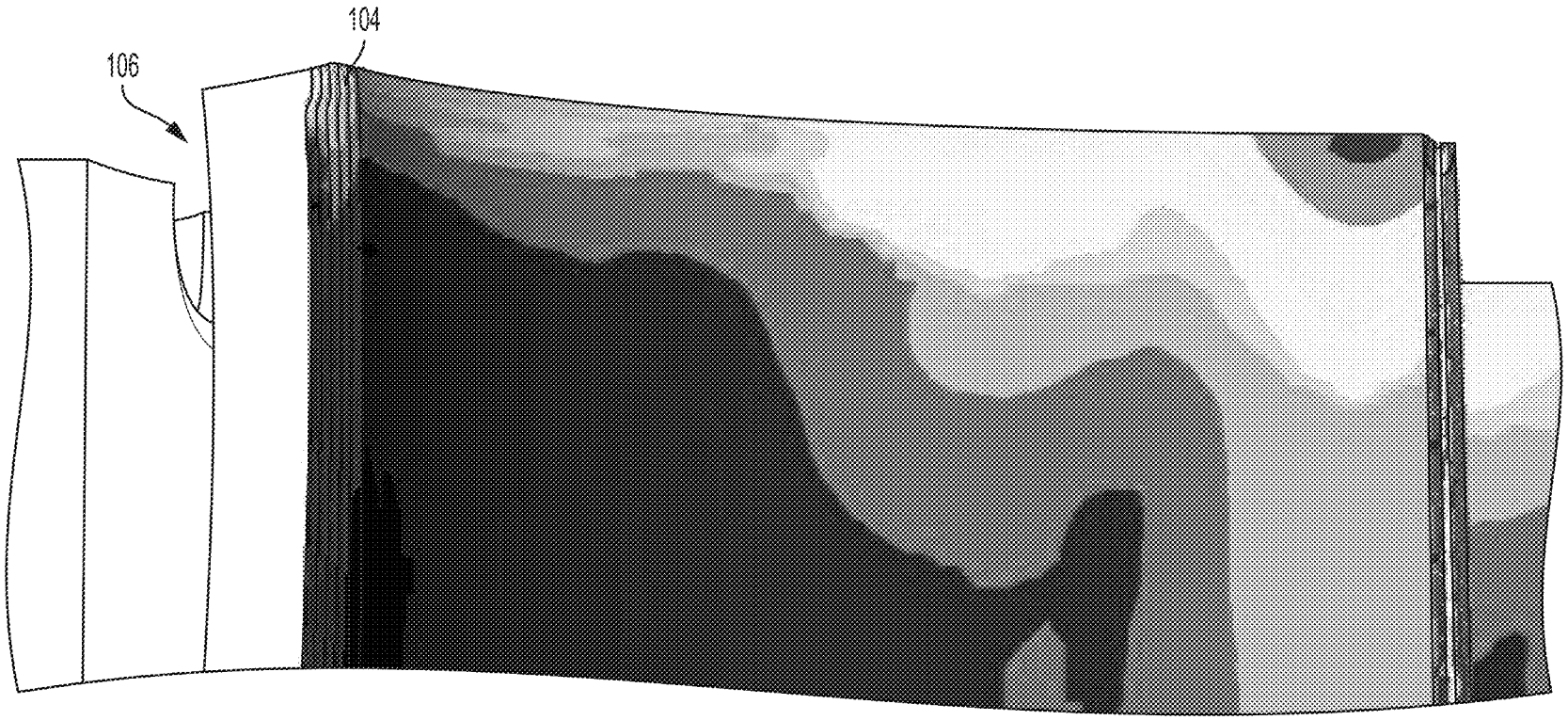
FIG. 4 is another isometric perspective cross-section view of the engine block 100.

FIG. 4 is another isometric perspective cross-section view of the engine block 100. Although somewhat exaggerated in the illustration, FIG. 4 illustrates that the residual stress, due to the difference in the coefficient of thermal expansion results in the engine block material contracting more than the liner, tends to pull the liner radially outward near the deck surface which results in a "bell mouthing" near the end of the liner. In other words, the engine block material tends to pull the liner downwardly as the engine block cools down. This results in a higher residual strain in a portion of the liner 110 near the deck face.

Figure 5:
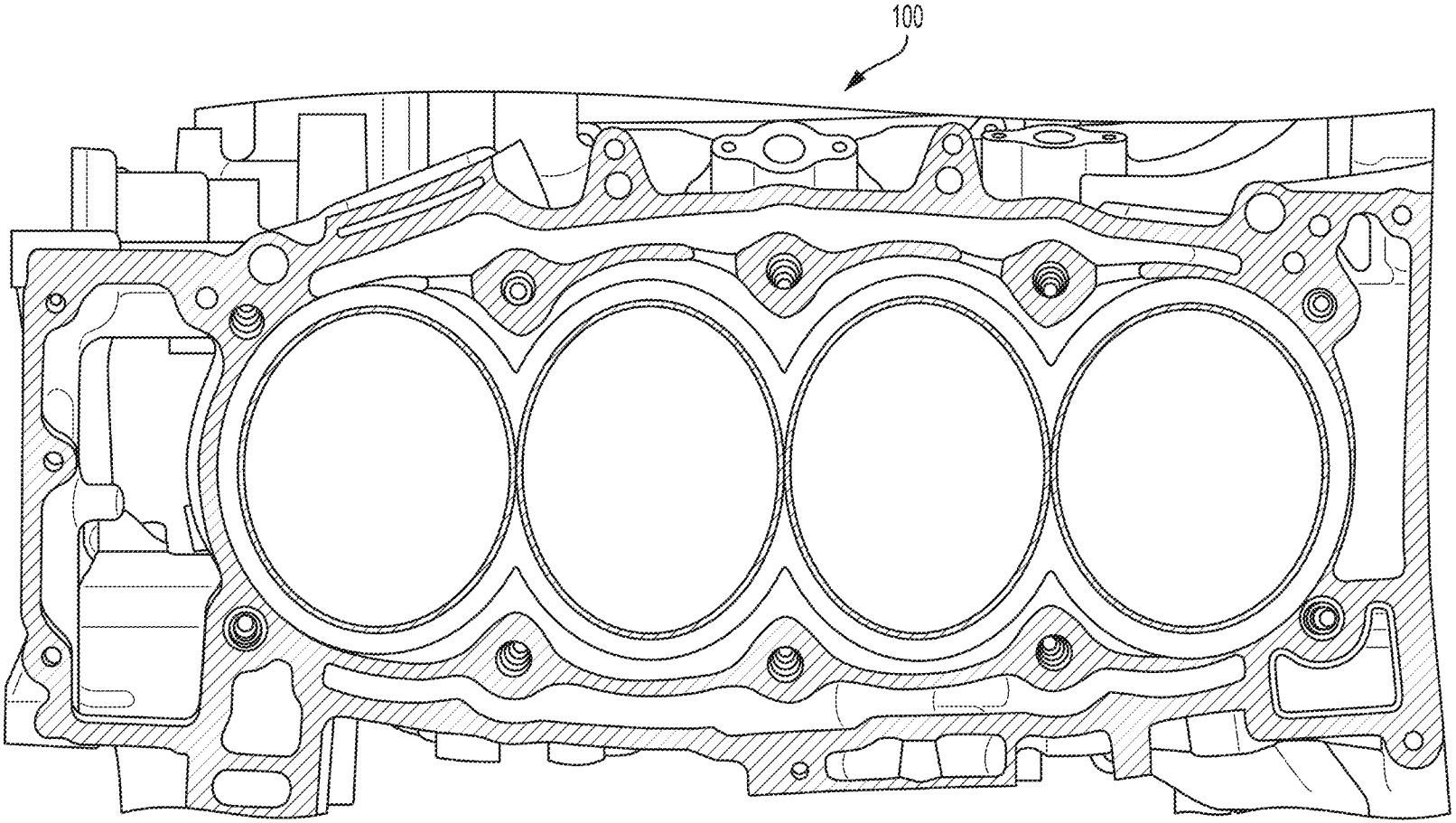
FIG. 5 is another plan view of the engine block 100.
Figure 6:
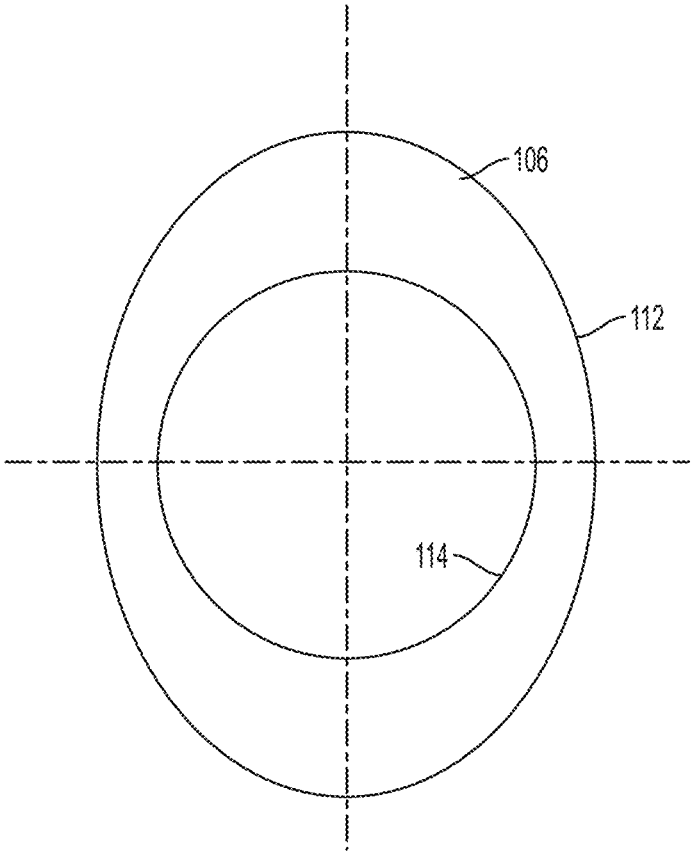
FIG. 6 illustrates the cylinder liner 110 with exaggerated distortions.

FIG. 5 is another plan view looking at the deck face of the engine block 100 which illustrates another issue. The thermal contraction of the engine block during the casting process tends to result in the cylinder liners becoming at least slightly oval in shape rather than circular. FIG. 5 is an illustration which greatly exaggerates the relative amount of ovality or distortion in the engine block for the purposes of understanding. This ovality tends to be greater in those cylinder bores which are more centrally positioned. Because of this ovality, the interior surface or inner bore of the cylinder liner is machined to bring the inner bore back to a more circular shape. FIG. 6 illustrates the cylinder liner 104 with exaggerated distortions such that the exterior surface has formed an oval shape. The inner bore 114 of the cylinder liner 104 has been machined to provide a circular shape. The ovality of the cylinder liner 104 exterior surface 112 in combination with the machined circular inner bore 114 results in a variation in wall thickness. In particular, the more oval the cylinder liner 104, the more material that must be removed to provide a circular inner bore 114, the greater the variance in liner wall, and the more thin the liner wall adjacent the inter-bore section of the engine block. The thinner wall tends to further focus or concentrate the stresses in the cylinder liner. Further, the thinner wall being positioned at a location adjacent to the inner-bore results in residual stresses being at their maximum.

Figure 8:
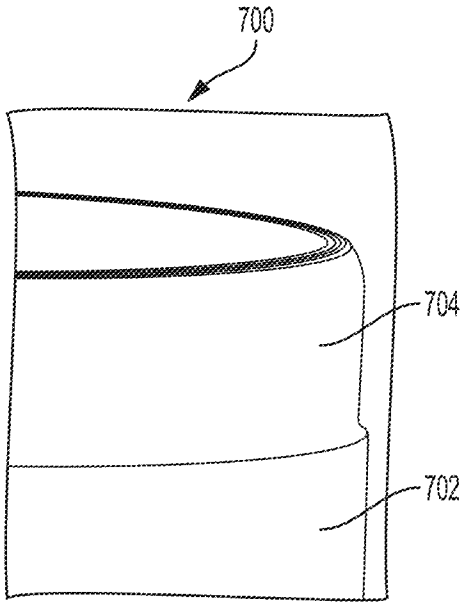
FIG. 8 illustrates an isometric perspective view of the end portion of the liner 700.
Figure 7:
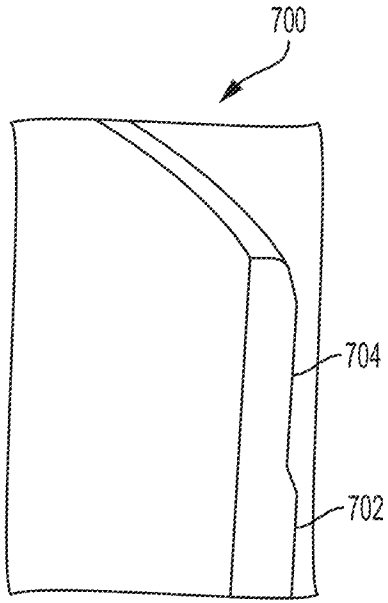
FIG. 7 illustrates a cross-sectional perspective view of an end portion of an exemplary embodiment of a cylinder liner 700 in accordance with the present invention.

FIG. 7 illustrates a cross-sectional perspective view of an end portion of an exemplary embodiment of a cylinder liner 700 in accordance with the present invention and FIG. 8 illustrates an isometric perspective view of the end portion of the liner 700. The exterior surface of the end portion of the liner 700 has a first engine block bonding surface 702 and a second engine block bonding surface 704. The first engine block bonding surface 702 includes an "as-cast" surface which provides excellent structural and thermal bonding with the engine block. In contrast, the second engine block bonding surface 704 is a surface which has had the "as-cast" surface removed resulting in a machined surface. In particular, the second engine block bonding surface 704 has a surface which does not structurally bond to the engine block material as well as that of the first engine block bonding surface 702. In this manner, during the casting and subsequent manufacturing process of the engine block incorporating the cast in place liner 700, the engine block material does not structurally bond to the second engine block bonding surface 704 as well as it does to the first engine block bonding surface 702. Since the engine block material does not bond as well structurally to the second engine block bonding surface 704, during the cooling of the engine block, the difference in the coefficients of thermal expansion results in the engine block material moving downward along the second engine block bonding surface 704 without pulling that surface. In this manner, the residual stress that would otherwise result that is illustrated and discussed previously is avoided or reduced significantly.

While the present description and exemplary embodiment refers to a second engine block bonding surface having a machined surface and a first engine block bonding surface having an "as-cast" surface, it is to be understood that the present invention includes any type of surfaces so long as the structural bonding between the second engine block bonding surface and the engine block material is less than that of the first engine block bonding surface and the engine block material.

Figure 9:
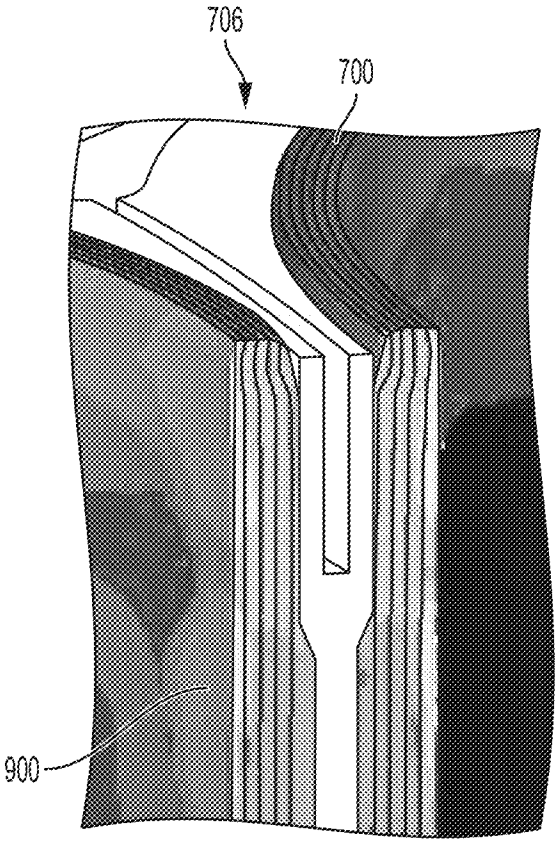
FIG. 9 is an isometric cross-sectional perspective view of a portion of an engine block 706 that includes the cylinder liner 700.

FIG. 9 is an isometric cross-sectional perspective view of a portion of an engine block 706 that includes the cylinder liner 700. FIG. 9 illustrates the residual stress in the cylinder liner which results from the casting and machining process as modeled by a computational model which accounts for the structural and thermal aspects of these processes, including the differences in the coefficients of thermal expansion. Comparing FIG. 9 with FIG. 3, the significant reduction in residual stress in the cylinder liner is quite striking. The residual stress in the cylinder liner 700 near the deck face and adjacent to the saw cut is greatly reduced in comparison with the conventional cylinder liner 104. In an exemplary embodiment, the second engine block bonding surface 704 axially extends from the end of the liner a distance which is greater than the depth of the saw cut in engine block. Reducing the structural bonding between the liner and the engine block material at a position adjacent to the saw cut relieves residual stress sufficiently to significantly minimize the potential for cylinder liner failures in this area. The axial extent of the second engine block bonding surface 704 should be sufficient to relieve residual stresses associated with the saw cut and, thus, the extent of the second engine block bonding surface 704 should be related to the depth of the saw cut. In an exemplary embodiment the second engine block bonding surface 704 axial length is at least as long as the depth of the adjacent saw cut. However, lengthening the axial extent of the second engine block bonding surface 704 too far beyond the depth of the saw cut will start to minimize the benefits of the as-cast surface and will serve to reduce the beneficial effects of the strong structural and thermal bonding provided by the as-cast between the cylinder liner and engine block material over other types of surfaces.

Further, FIG. 9 illustrates that the engine block material has moved downwardly along the exterior surface of the liner 700 such that the end of the cylinder liner projects slightly above the deck face of the engine block material. In other words, the end of the cylinder liner 700 "stands proud" above the adjacent engine block material on the deck face. This is in contrast to that of the conventional engine block in which the liner 104 does not project above the deck face of the engine block material because the engine block material pulls the liner downwardly.

Figure 10:
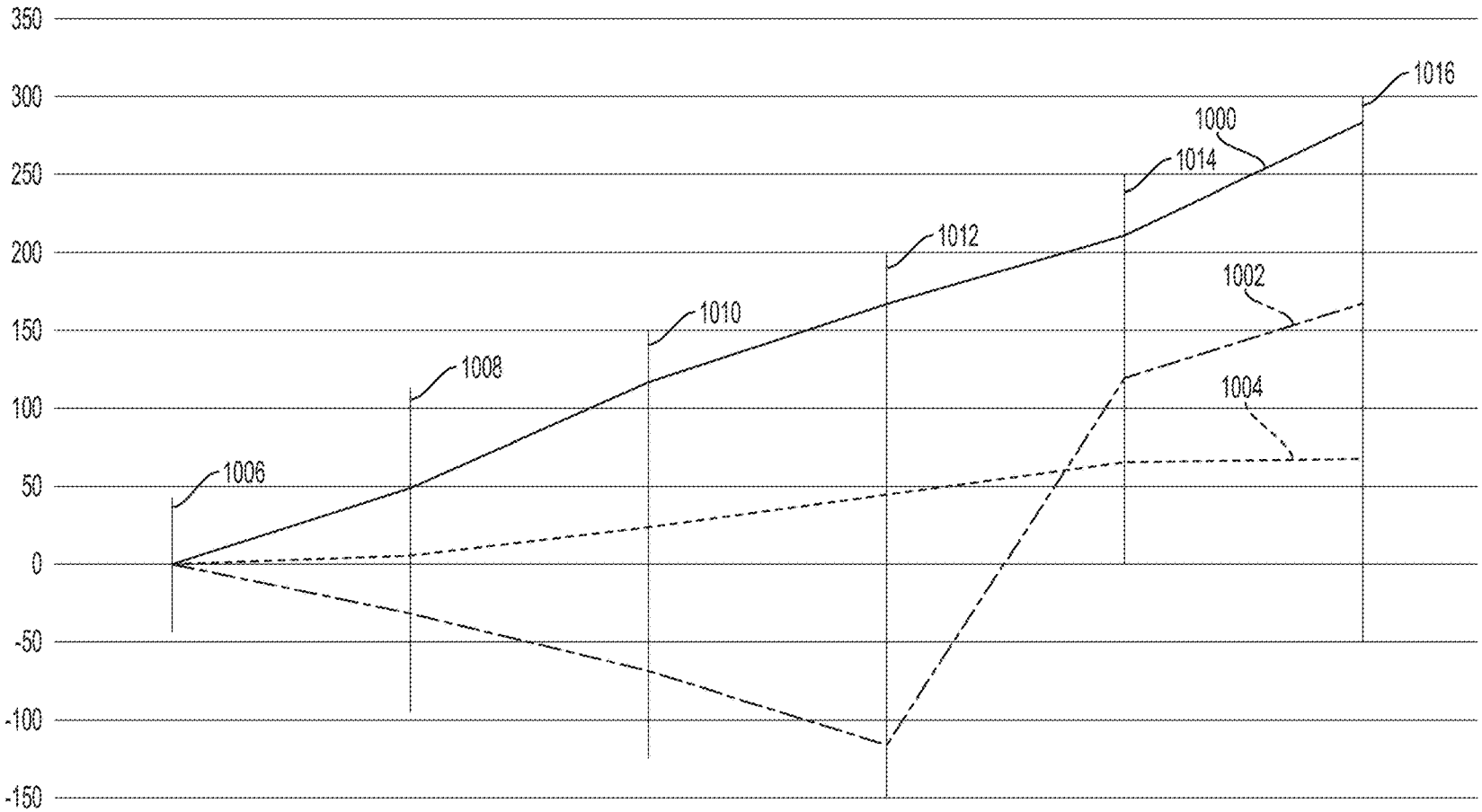
FIG. 10 is a graph which illustrates the residual stress in a conventional cylinder liner and an inventive cylinder liner as they both transition through exemplary manufacturing processes.

For purposes of further comparison and illustration of the advantages of the present invention, FIG. 10 is a graph that illustrates the residual stress in a conventional cylinder liner and an exemplary inventive cylinder liner as they both transition through exemplary manufacturing processes. The horizontal axis of the graph represents the progression of the engine block through the various manufacturing processes. The vertical axis of the graph represents the amplitude of the residual stress in the cylinder liner. Line 1000 represents the residual stress of an end portion of a conventional cylinder liner adjacent the inter-bore section of the cylinder block, line 1004 represents the residual stress of an end portion of an exemplary cylinder liner adjacent the inter-bore section of the cylinder block in accordance with the present invention, and line 1002 represents the residual stress of a portion of the same exemplary cylinder liner adjacent the inter-bore section but at a location which is axially displaced from the end of the liner and just past the depth of the saw cut in the inter-bore. The location corresponding to line 1002 is indicated in FIGS. 9 and 11 by reference numeral 900.

The manufacturing process starts at 1006 where the molten engine block material is introduced into a mold which incorporates the cylinder liner(s). Between 1006 and 1008, the engine block cools to a solid within the mold. During this cooling the stress introduced into the conventional cylinder liner as indicated by line 1000 rises significantly faster than that of the inventive cylinder liner as indicated by lines 1002 and 1004. The engine block is removed from the mold at 1008 and then cools to ambient temperature until 1010. Again, as is clearly illustrated, the residual stress continues to rise significantly higher in the conventional liner 1000 in comparison to that of the inventive liner 1002 and 1004. Next, between 1010 and 1012, the interior surface of the cylinder liner experiences a rough machining operation which removes material from the walls of the cylinder liner and further concentrates the residual stress. This is true especially with the reduction in the ovality in the inventive cylinder liner in comparison with the conventional cylinder liner.

Between 1012 and 1014, the inter-bore section is machined to provide the saw cut and between 1014 and 1016 the interior surface of the cylinder liner is further machined to provide a finish bore surface. As is clearly evident, each progressive step in the manufacturing process results in a continuing increase in residual stress at an end portion of the conventional cylinder liner. In stark contrast, the residual stress in all portions of the inventive cylinder liner is substantially less. In particular, the residual stress in an end portion of the cylinder liner adjacent to the deck face 1004 is substantially reduced.

Figure 11:
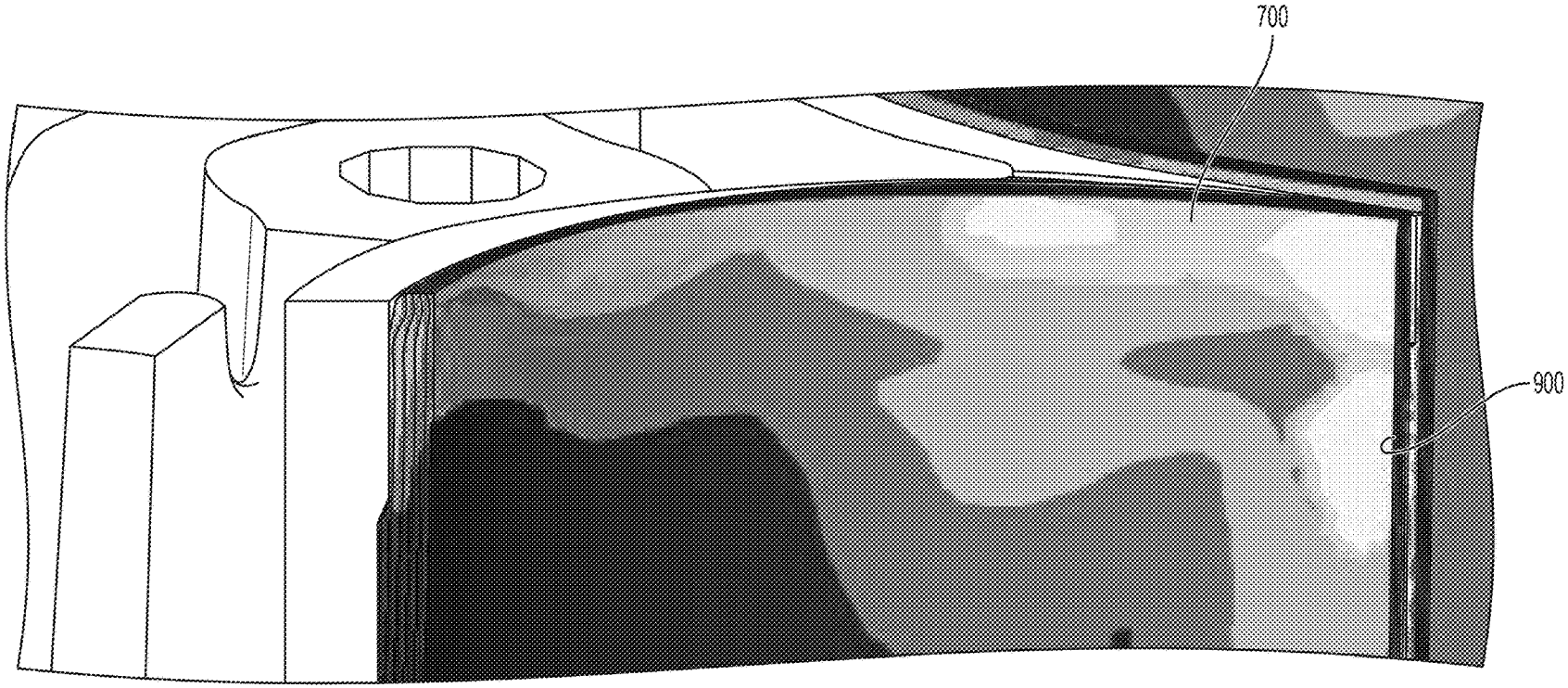
FIG. 11 is another illustration of the cylinder liner 700.

Viewing FIG. 10 in combination with FIGS. 9 and 11, also illustrates that the residual stress at location 900 in the inventive cylinder liner is slightly higher than that of the end portion. However, even the residual stress at that location is significantly lower than that of the end portion of the conventional cylinder liner.

FIG. 11 further illustrates that the end portion of the cylinder liner 700 does not bell mouth or flex radially outward as much as that of the convention liner 110 as shown in FIG. 4. This further illustrates the reduction in ovality. The reduction in ovality means that less material needs to be removed from the walls of the liners to achieve a circular inner bore which results in an improved strength and further reduces the opportunity for failures to occur This reduction in residual stress has multiple advantages in that it minimizes the stress which may have previously been the cause of failures and/or cracking of the cylinder liner near the end portion adjacent to the inter-bore, bell mouthing is reduced, and ovality is reduced.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A cylinder liner for an engine block that includes an inter-bore saw cut, comprising:

a first engine block bonding surface; and a second engine block bonding surface that has a lower level of bonding between the cylinder liner and an engine block than the first engine block bonding surface, the second engine block bonding surface axially extending from an axial end portion of the liner a distance greater than a depth of the saw cut in an inter-bore section of the engine block, wherein the first engine block bonding surface comprises an as-cast surface.

2. The liner of claim 1, wherein the as-cast surface comprises a spiny-lock surface.

3. The liner of claim 1, wherein the as-cast surface comprises a plurality of projections radially extending between about 0.3 to 0.7 millimeters.

4. The liner of claim 1, wherein the second engine block bonding surface comprises a machined surface.

5. The liner of claim 1, wherein the first engine block bonding surface axially extends from the second engine block bonding surface across substantially the remaining axial extent of the liner.

6. The liner of claim 1, wherein the first engine block bonding surface is configured to provide a strong mechanical bond and a high thermal conductivity between the liner and the engine block and wherein the second engine block bonding surface is configured to provide a reduced mechanical bond between the liner and the engine block such that a differing coefficient of thermal expansion between the liner material and the engine block material has a reduced stress transfer from the engine block to the liner during a cooling of the liner material and the engine block material in a casting process.

7. The liner of claim 1, wherein the second engine block bonding surface is configured to permit an axial displacement between the second engine block bonding surface and the engine block during a cooling of the cylinder liner and engine block material.

8. A method of manufacturing a cylinder liner for an engine block that includes an inter-bore saw cut, the method comprising:

providing a cylinder liner having a first engine block bonding surface; and removing a portion of the first engine block bonding surface to provide a second engine block bonding surface having a lower level of bonding between the cylinder liner and the engine block than the first engine block bonding surface, wherein the second engine block bonding surface axially extends from an axial end portion of the liner a distance greater than a depth of the saw cut in an inter-bore section of the engine block.

9. The method of claim 8, wherein the first engine block bonding surface comprises an as-cast surface.

10. The method of claim 9, wherein the as-cast surface comprises a spiny-lock surface.

11. The method of claim 9, wherein the as-cast surface comprises a plurality of projections radially extending between about 0.3 to 0.7 millimeters.

12. The method of claim 8, wherein removing a portion of the first engine block surface comprises machining a portion of the first engine block surface.

13. The method of claim 8, wherein the first engine block bonding surface extends from the second engine block bonding surface across substantially the remaining axial extent of the liner.

14. The method of claim 8, wherein the first engine block bonding surface provides a strong mechanical bond and a high thermal conductivity between the liner and the engine block and wherein the second engine block bonding surface provides a reduced mechanical bond between the liner and the engine block such that the differing coefficient of thermal expansion between the liner material and the engine block material has a reduced stress transfer from the engine block to the liner during a cooling of the liner material and the engine block material in a casting process.

15. The method of claim 8, wherein the second engine block bonding surface is configured to permit an axial displacement between the second engine block bonding surface and the engine block during a cooling of the cylinder liner and engine block material in a casting process.

* * * * *